United States Patent [19]

Ehlbeck

[11] Patent Number: 4,964,244

[45] **Date of Patent: * Oct. 23, 1990**

[54] ENERGY DISSIPATING RECEPTACLE FOR HIGH-VELOCITY FLUID JET

[75] Inventor: Uwe Ehlbeck, Darmstadt, Fed. Rep. of Germany

[73] Assignee: Flow Systems, Inc., Kent, Wash.

[ * ] Notice: The portion of the term of this patent subsequent to Jun. 2, 2004 has been disclaimed.

[21] Appl. No.: 937,068

[22] Filed: Dec. 2, 1986

Related U.S. Application Data

[63] Continuation of Ser. No. 753,480, Jul. 10, 1985, Pat. No. 4,669,229.

[51] Int. Cl.[5] ..... B24B 55/04

[52] U.S. Cl. ..... 51/270; 51/274; 51/410; 51/424

[58] Field of Search ..... 51/270, 274, 319, 320, 51/321, 410, 424; 83/53, 177; 181/208, 288

[56] References Cited

U.S. PATENT DOCUMENTS

| | | | |
|---|---|---|---|
| 532,374 | 1/1895 | Hermes . | |
| 2,732,040 | 1/1956 | De Vost et al. | 188/101 |
| 2,985,050 | 5/1961 | Schwacha | 83/53 |
| 3,110,262 | 11/1963 | West | 102/54 |
| 3,212,378 | 10/1965 | Rice | 83/53 |
| 3,637,051 | 1/1972 | Paine et al. | 188/1 B |
| 3,730,040 | 5/1973 | Chadwick et al. | 83/177 |
| 3,978,748 | 9/1976 | Leslie et al. | 83/177 X |
| 4,112,797 | 9/1978 | Pearl | 83/177 |
| 4,137,804 | 2/1979 | Gerber et al. | 83/177 |
| 4,501,182 | 2/1985 | Jardat et al. | 83/177 |

FOREIGN PATENT DOCUMENTS

| | | | |
|---|---|---|---|
| 2720547 | 11/1977 | Fed. Rep. of Germany | 83/177 |

*Primary Examiner*—Frederick R. Schmidt
*Assistant Examiner*—M. Rachuba
*Attorney, Agent, or Firm*—Ashen Martin

[57] ABSTRACT

An energy-dissipating receptacle for use with a fluid jet cutting system is disclosed. A plurality of circulating suspensoids within the cavity are impinged upon by the jet to dissipate the jet's kinetic energy. A filtered drain are included for permitting the egress of spent jet fluid while retaining the suspensoids.

10 Claims, 2 Drawing Sheets

ENERGY DISSIPATING RECEPTACLE FOR HIGH-VELOCITY FLUID JET

This is a continuation of co-pending application Ser. No. 753,480 filed on July 10, 1985 now U.S. Pat. No. 4,669,229, issued 6/2/87.

This invention relates to fluid jet cutting systems, and more specifically, to the energy-dissipating receptacle associated with such systems.

Cutting by means of a high velocity fluid jet is well known in the art. Typically, a fluid, such as water, at a pressure of 55,000 pounds per square inch is forced through a jewel nozzle having a diameter of 0.003 to 0.030 inches to generate a jet having a velocity of up to three times the speed of sound. The jet thus produced can be used to cut through a variety of metallic and non-metallic materials such as steel, aluminum, paper, rubber, plastics, Kevlar, graphite and food products.

To enhance the cutting power of the fluid jet, abrasive materials have been added to the jet stream to produce a so-called "abrasive jet". The abrasive jet is used to effectively cut a wide variety of materials from exceptionally hard materials such as tool steel, armor plate, certain ceramics and bulletproof glass to soft materials such as lead. Typical abrasive materials include garnet, silica and aluminum oxide having grit sizes of #36 through #120. As used herein, the term "fluid jet" is used generically to mean fluid jets and abrasive jets.

The high energy of the fluid jet must somehow be absorbed once it has passed through the workpiece. Not only is the jet a danger to person or equipment which might accidentally be impinged, but the fluid forming the jet must also be collected for proper disposal.

Accordingly, fluid jet cutting systems have included an energy-dissipating receptacle for receiving the high velocity jet of fluid. For example, U.S. Pat. Nos. 2,985,050 and 3,212,378 disclose a catch tank containing water or other fluid above a resilient pad of rubber or neoprene or other elastomeric material. Spray rails are provided on each side of the tank with a waterspray being directed downwardly over the liquid surface to blanket the vapors of the cutting fluid and prevent their disbursal in the area of the cutting machine.

U.S. Pat. No. 3,730,040 discloses an energy-absorbing receptacle containing a hardened steel impact block at the bottom of the receptacle, and a frusto-conical baffle arrangement immediately adjacent the workpiece at the top of the receptacle. The jet passes into the receptacle, through a liquid in the receptacle which absorbs a portion of the jet's energy. The jet thereafter impacts the steel block at the bottom of the receptacle. The orientation of the baffle plates are described as preventing sound, spray and vapor from passing back out of the entrance.

Energy-dissipating receptacles, or catchers, which are known in the art suffer from two basic problems. First, conventional catchers, particularly those used with abrasive jets, have experienced excessive wear and have required relatively expensive wear components. Owing to the cutting force of the jet, these components have still experienced relatively short useful lives.

Secondly, the catcher housing has heretofore been large and expensive owing to both the quality and quantity of required metal. Thick metallic walls have been required to ensure against penetration by the fluid jet, particularly the abrasive jet. Additionally, the conventional catcher body has been relatively long in the direction of jet flow in order to provide a sufficient energy-dissipating path through the interior of the receptacle. For example, conventional catchers have typically been up to 36 inches long in the direction of jet travel.

Accordingly, the present invention is directed to a method and apparatus for dissipating the energy of a high velocity jet of fluid which overcomes the aforementioned limitations. Briefly, an energy-dissipating receptacle for receiving a high velocity jet of fluid is disclosed comprising a body having an internal cavity for holding a contained fluid and for receiving a high velocity jet of fluid. The receptacle further includes a bed of freely movable suspensoids within the cavity. Level limiting means are included for permitting the eggress of excess dissipated fluid from the cavity, while retaining substantially all of the suspensoids therein. The jet is received within the receptacle so that it impinges on at least some of the suspensoids.

As the abrasive jet penetrates the bed of suspensoids, at least some of them become suspended within the contained fluid. Because of their ability to move relatively freely within the cavity, the members move within the fluid to absorb at least some of the energy of the impinging jet with minimal suspensoid damage.

Jet-related wear of the suspensoids is further minimized by a circulatory movement imparted to them by the entrance of the jet into the contained fluid. In the preferred embodiment, this circulatory movement is maximized by providing a receptacle interior having a converging cross-section.

The preferred converging receptacle interior, together with the use of circulating suspensoids permits a substantial shortening of the catcher's length.

These and other details concerning the invention will be apparent in the following description of the preferred embodiment, of which the following drawing is a part.

DESCRIPTION OF THE PREFERRED EMBODIMENT

Figure 1:
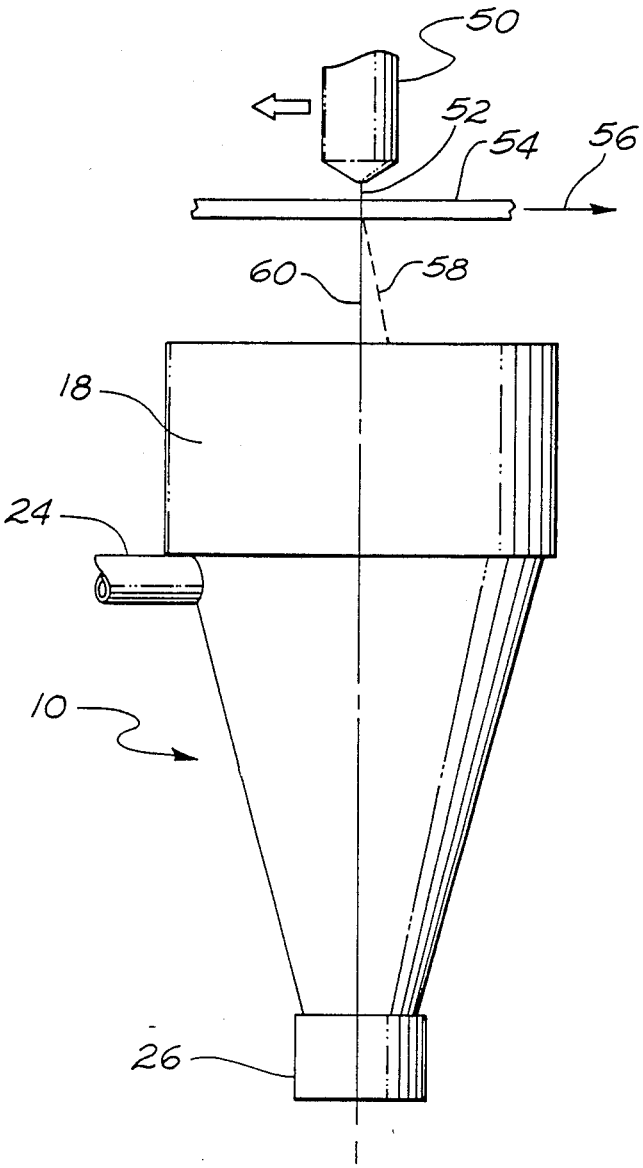
FIG. 1 is an elevation view, in schematic, of a fluid jet cutting system constructed in accordance with the invention.

Referring initially to FIG. 1, a fluid jet cutting system is illustrated comprising a nozzle 50 for producing a high velocity jet of fluid 52. Typically, the fluid is water, or a water/abrasive mixture. The fluid is forced at a pressure of approximately 55,000 lbs./sq.in. through a jewel nozzle having a diameter of 0.003 to 0.030 inches, producing a jet having a velocity of up to three times the speed of sound.

A sheet of material 54 is positioned below the nozzle for penetration by the jet 52. The material 54 is moved relative to the nozzle 50 such as in the direction indicated by arrow 56. The cut is made in the direction opposite to the movement of material, as illustrated in FIG. 1.

During the cutting process, the jet 52 passes through the material 54 and enters an energy-dissipating receptacle 10. In practice, the jet may be deflected by the material, with such deflection being in the direction opposite to the direction of cut. The path of a deflected jet emerging from the material is accordingly represented schematically in FIG. 1 as a dotted line 58.

In a typical cutting system, the fluid jet emerges from the nozzle in a generally downward, vertical direction. The catcher is located beneath the cut material, and in alignment with the jet.

Alignment between a deflected jet and the receptacle can be provided for in a number of ways. First, the receptacle 10 can be offset from a position directly under the nozzle so that the deflected jet enters the receptacle at an angle with respect to the receptacle's axis 60, but along a path which does not immediately impinge on the interior of the receptacle. In the arrangement depicted in FIG. 1, the position of receptacle 10 would be offset to the right.

In addition, the receptacle 10 can be tilted slightly so that its axis 60 is co-axially aligned with the path 58, thereby maximizing the length over which the jet can travel within the receptacle before impinging on the interior wall.

Figure 2:
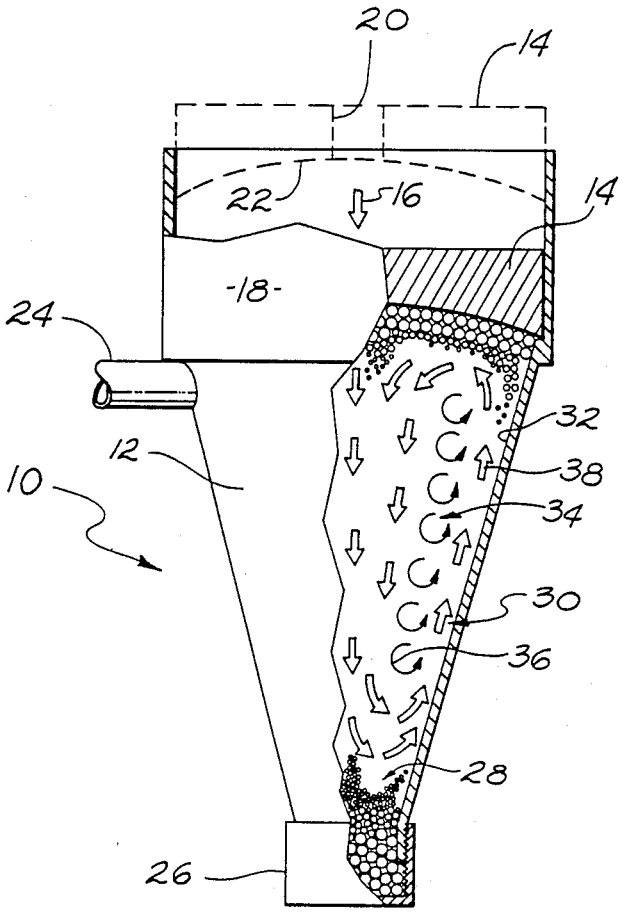
FIG. 2 is a partially sectioned elevation view, in schematic, of an energy-dissipating receptacle for receiving a high velocity jet of fluid, constructed in accordance with the invention.

Referring to FIG. 2, an energy-dissipating receptacle 10 constructed in accordance with the invention is shown in a partially sectioned elevation view in schematic. The receptacle 10 includes a body 12 typically formed from sheet metal such as 12 gauge steel and adapted to receive a high velocity fluid jet.

For purposes of illustration, the axis and direction of travel of the jet are represented by a vertical downward-extending arrow 16, which is generally co-axially aligned with the receptacle axis 60. As previously indicated, general coaxial alignment is preferable and can be accomplished with respect to a deflected jet by appropriately tilting the receptacle.

The body 12 has a generally annular cross-section, the internal diameter of which is convergingly shaped in the direction of fluid flow. The illustrated body is a conical section, the downwardly-extending interior wall of which preferably forms a 10°–45° angle with the axis of fluid jet. The interior of the converging inner sidewall may be lined with a non-metallic, sound-absorbing, abrasive-resistant material such as rubber.

The top portion of the receptacle 10 includes a cover 14 preferably formed from white-cast iron. The cover 14 is dimensioned to fit inside the upper portion of the body 12 and the body 12 accordingly includes an upper cylindrical region 18 dimensioned to receive the cap 14 to a predetermined depth inside the body.

The cover 14 includes a through-bore 20, dimensioned to circumvent the fluid jet and permit it to pass into the enclosed receptacle. The bottom surface 22 of the cover 14 can be flat but is preferably concave for reasons which will be described hereinbelow.

The body 12 additionally includes liquid level limiting means for permitting the eggress of excess dissipated fluid from the cavity. A generally tubular conduit 24 is accordingly provided, whose interior is in fluid communication with the interior of the receptacle 10. Although the conduit 24 is preferably located in the upper region of the generally cylindrical section, it may also be located at the bottom of the receptacle. In addition, a partial vacuum may be applied to the conduit to aid in the removal of the dissipated fluid and abrasive.

The bottom portion of the conical body section preferably a removable and replaceable closure member in the form of a generally cylindrical, internally threaded cap 26 which engages external threads formed about the bottom end of the conical section. The cap 26 is conveniently formed from cast iron and includes an internal steel plug.

The receptacle thus described preferably has a height of 12 to 14 inches, and a diameter of approximately 5–7 inches across its generally cylindrical region 18.

The receptacle is filled to approximately the level of the cap's bottom surface 22 with a plurality of freely-movable suspensoids 28. A mixture of steel grinding balls of $\frac{1}{4}$–$\frac{3}{8}$ inch diameter and steel shot has been used as the suspensoids 28, wherein the steel shot are 1/6–$\frac{1}{8}$ inch diameter cylinders having a length approximately equal to their diameter and heat-treated to a Rockwell hardness of C55 or above.

Prior to entry of the fluid jet, the balls and shot 28 form a bed extending from the top cover to the bottom of the receptacle 10. The cover 14 is initially in a relatively elevated position, as depicted by the dotted lines in FIG. 1. The receptacle 10 is positioned with respect to the fluid jet so that the jet enters the receptacle through the bore 20. Once inside the receptacle, it has been found that the jet slows, turns, and spreads due to the resistance of the 10 energy-absorbing bed. As the jet spreads and turns, it begins flowing upward at an angle of 20°–35°. By forming the interior sidewalls of the receptacle at a similar angle, the jet's upward flow is a laminar, low-energy flow along the wall, as illustrated at 30. The lining 32 is accordingly subjected to minimal force and wear.

While either type of suspensoid can be used alone, and the relative quantities of each can be varied to form a suitable mixture, optimum results appear to be obtained with a mixture comprised of shot and 5 to 25% (by volume) of $\frac{1}{4}$–$\frac{3}{8}$ inch balls.

When the fluid jet penetrates the bed of grinding balls and shot, a strong movement of the smaller members leads to a suspension, or flotation, of the larger members as a result the suspensoid bed appears to become fluidized; i.e., a substantial number of the suspensoids become separated from each other by a thin layer of dissipated fluid, permitting a circulating motion of the bed to take place. The larger members appear to circulate within the laminar regions in the manner depicted by the broader arrows 38 in FIG. 2, while the smaller members appear to circulate within a turbulent zone 34 lying inside the conical laminar boundary in the manner depicted by the thinner arrows 36. The concave internal surface 22 of the cap 14 facilitates the circulation of the grinding balls and steel shot.

The majority of the fluid jet's energy appears to be expended in the turbulent zone 34. The most wear-prone part of the assembly is the inexpensive and easily replaced balls and shot 28. Because the balls and shot 28 are freely movable within the receptacle, they are minimally damaged by impingement of the fluid jet. Since these elements are, however, subject to impingement, and therefore wear, it is foreseeable that the suspensoids will eventually be reduced in dimension to a size where they serve no useful purpose. When their size decreases below that useful minimum, however, they can be allowed to pass outward through conduit 24 by means of any suitable filter, such as a screen, which retains the remaining balls and steel shot within the receptacle.

As the quantity of suspensoids decreases owing to wear, the cover 14 sinks within the upper cylindrical portion of the receptacle to the depicted position of the partially sectioned cover. The cover accordingly provides some degree of volumetric adjustment to compensate for the loss of suspensoids during use of the receptacle.

In addition to the suspensoids, the only remaining portion of the receptacle which may be susceptible to wear by the jet is the jet-facing bottom of the catcher. The removable cap 26 accordingly allows inexpensive replacement of that wear-prone part of the assembly while also facilitating cleaning procedures.

The energy-dissipating characteristics of the illustrated receptacle permit it to be only 12 to 14 inches, or less, in length in the direction of fluid jet travel. Because of the very low fluid energy within the conical laminar boundary, the interior wall of the receptacle is subjected to relatively nondestructive levels of kinetic energy. The laminar action along the interior wall permits use of a relatively inexpensive, but effective sound-dampening material such as rubber for the inner liner.

While the foregoing description includes detailed information which will enable those skilled in the art to practice the invention, it should be recognized that the description is illustrative and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. An energy dissipating receptacle for receiving a high velocity jet of fluid comprising:

a body having an internal cavity for receiving a high velocity jet of fluid;

a circulating bed of suspensoids within the cavity responsive to the reception of the high velocity jet in the cavity to cause the jet to impact generally equally on a large number of the suspensoids comprising the bed; and means for permitting the egress of dissipated fluid from the cavity while retaining the suspensoids therein.

2. The receptacle of claim 1 wherein at least some of the suspensoids are steel.

3. The receptacle of claim 1 wherein the suspensoids are selected from the group consisting of generally spherically shaped and generally cylindrically shaped bodies.

4. The receptacle of claim 3 wherein at least some of the suspensoids are generally cylindrical bodies approximately $\frac{1}{8}$ inch in diameter and $\frac{1}{8}$ inch in length.

5. The receptacle of claim 3 wherein at least some of the suspensoids are selected from the group consisting of grinding balls and shot.

6. The receptacle of claim 3 wherein at least some of the suspensoids are generally spherical spheres of steel of approximately $\frac{1}{4}$ to $\frac{3}{8}$ inch diameter.

7. A method for absorbing the kinetic energy of a high velocity fluid jet comprising the step of:

receiving the jet within a cavity containing a circulating bed of suspensoids so that a substantial portion of the suspensoids comprising the bed are briefly contacted by the entering jet.

8. A method for absorbing the kinetic energy of a high velocity fluid jet comprising the steps of:

partially filling the cavity of a receptacle with plurality of suspensoids;

aligning the cavity and fluid jet to receive the fluid jet within the cavity;

allowing relatively low kinetic energy fluid to accumulate within the cavity during receipt of the fluid jet the suspensoids being sized with respect to the cavity for circulation within the accumulated fluid in response to impingement by the fluid jet.

9. The method of claim 8 including the step of shaping the interior of the cavity to allow substantially laminar flow of the accumulated liquid along the interior walls.

10. The receptacle of claim 1 wherein the cavity shape is dimensioned to create a substantially laminar flow of dissipated fluid along the interior walls of the cavity.

* * * * *